US006089634A

United States Patent [19]

Verhey

[11] Patent Number: 6,089,634

[45] Date of Patent: Jul. 18, 2000

[54] SAFETY LIFTING DEVICE

[75] Inventor: Walter Verhey, Ancaster, Canada

[73] Assignee: Walters Inc., Hamilton, Canada

[21] Appl. No.: 09/258,271

[22] Filed: Feb. 26, 1999

[51] Int. Cl.[7] ..... B66C 1/34

[52] U.S. Cl. ..... 294/82.35

[58] Field of Search ..... 294/75, 82.17, 294/82.19, 82.21, 82.22, 82.23, 82.24, 82.27, 82.31, 82.34, 82.35; 24/598.3, 600.8, 601.6

[56] References Cited

U.S. PATENT DOCUMENTS

| | | | |
|---|---|---|---|
| 1,751,309 | 3/1930 | De Mone | 294/82.35 |
| 3,895,836 | 7/1975 | Barnes | 294/82.35 |
| 4,453,622 | 6/1984 | Betz | 294/82.35 |
| 5,108,139 | 4/1992 | Leech | 294/82.19 |
| 5,152,567 | 10/1992 | Raber | 294/82.35 |

OTHER PUBLICATIONS

Blueprint drawing by Walters Inc. draftsman depicting Canron Lifting Device in public use circa 1986.

Blueprint drawing by Walters Inc. draftsman depicting Hepburn Lifting Device in public use circa 1992.

Blueprint drawing by walters Inc. draftsman depicting Canron Lifting Device in public use circa 1995.

*Primary Examiner*—Dean J. Kramer

*Attorney, Agent, or Firm*—Patrick J. Hofbauer

[57] ABSTRACT

A lifting device detachably interconnecting a lifting machine to a lug is disclosed, comprising a body having a longitudinal axis and a throughpassage having an axis transverse thereto, which throughpassage extends between first and second lateral sides of the body; a shackle connecting the body to the lifting machine; a lift pin having a head, a shaft extending therefrom along a major axis to an end, a bore extending through the shaft adjacent the end, substantially normal to the major axis, the shaft being insertable into the throughpassage to a fully inserted position, whereat a terminal section of the shaft containing the end and the bore projects from the first lateral side with the bore substantially vertical, the head projects from the second lateral side, and an intermediate section of the shaft between the terminal section and the head is positioned to provide lifting engagement of the lug; a stop pin having a head and a shaft extending from the head which is, when the lift pin is fully inserted, insertable into the bore to a locked position whereat the stop pin head provides interfering contact with the first lateral side, thereby preventing withdrawal of the lift pin; lift pin line and stop pin lines, connected to the lift pin and stop pin heads, respectively, for withdrawal of the lift pin and stop pin, and a guide member on the body for directing tensile force applied upon a distal end of the stop pin line to the stop pin head.

20 Claims, 7 Drawing Sheets

SAFETY LIFTING DEVICE

FIELD OF THE INVENTION

The present invention relates to the field of lifting devices, and more particularly, to a safety lifting device for use with a lifting means, such as a crane.

BACKGROUND OF THE INVENTION

In industry and construction, it is necessary that heavy loads can be safely lifted and transported by a lifting means, such as a crane. In this regard, a primary safety issue relates to the inadvertent release of the load during operation.

It is known in the prior art for rigid mechanical connections, such as nut and bolt assemblies, to be utilized to connect loads to lifting means during operation. The use of rigid mechanical connections is advantageous, as such connections are inexpensive to purchase, are relatively lightweight, and are not susceptible to the accidental release of the load during operation. However, rigid mechanical connections are inconvenient, in that workers are required to mechanically connect and disconnect the lifting means to and from each load, which can be time-consuming and difficult, especially at high altitudes. This situation is compounded by worker safety legislation enacted in many jurisdictions which prohibits workers from working at elevated positions without a fall arrest system. In some jurisdictions, this legislation can require that another crane or manlift be used for workers to disconnect the rigging, which is at all times an expensive proposition, and, in some applications, a very awkward solution, depending upon the site conditions.

Lifting devices of the general type comprising a body member, adapted to operatively receive a lifting lug rigidly attached to a load and having a throughpassage extending therethrough adapted to receive a lift pin, which lift pin operatively rigidly connects the lifting lug to the body member, are known in the prior art. In known devices of this general type, when the body member is connected to a lifting means and is in receipt of the lifting lug, and a pull line is attached to the lift pin, such known lifting devices are capable of conveniently engaging loads for the lifting and transporting of same by the sliding insertion of the lift pin into the throughpassage, and for disengaging same by a distant operator by operative application of tensile force upon the pull line, thereby effecting sliding withdrawal of the lift pin from within the throughpassage. Additionally, known safety devices comprise a safety pin, insertable into a bore in the lift pin such that the lift pin can not be withdrawn from the throughpassage without first extracting the safety pin from the bore. One such known lifting device of this general type is a device previously manufactured and made available to the public by John T. Hepburn, Limited, of Toronto, Ontario, Canada, in or about 1992 (hereinafter, the "Hepburn device").

Such known lifting devices maintain the economy and relatively low weight of rigid mechanical connections. However, the Hepburn device suffers in that rotation of the lift pin in the throughpassage may occur, such that tensile forces applied upon the pull line may not be directed to extract the safety pin from the bore, resulting in an inability to remotely disconnect the load. Additionally, the Hepburn device suffers from unreliability with respect to the issue of accidental release of the load, which unreliability is related to the fact that the single pull line utilized in the Hepburn device is attached to the safety pin and to the lift pin, and that undesirable tensile force may be applied upon the pull line by same becoming snagged, thereby simultaneously disengaging the safety pin and the lift pin, with inadvertent release of the load. Needless to say, this can have disastrous consequences to workers and other ground personnel.

The problem of the Hepburn device relating to rotation of the lift pin in the throughpassage, namely, the inability to remotely disconnect the load upon said rotation, was addressed in a device manufactured and made available to the public by Canron Inc., of Toronto, Ontario, Canada, in or about 1995 (hereinafter, the "Canron device"). The Canron device differs from the Hepburn device, inter alia, in that the safety pin for arresting withdrawal of the lift pin from within the throughpassage is upwardly inserted into the bore in the lift pin, to a locked position, and is arrested from falling out of the bore by a spring-loaded ball bearing. The Canron device resolves, to a limited extent, the problem caused by rotation of the lift pin in the throughpassage. However, the Canron device does not resolve the problem of undesirable load release caused by inadvertent application of tensile force upon the pull line.

SUMMARY OF THE INVENTION

It is an object of the present invention to overcome, inter alia, the shortcomings of the prior art described above by providing a safety lifting device which is economical to manufacture, which is not unduly heavy with respect to other devices capable of engaging and supporting the same load, which is capable of conveniently and safely engaging loads, which is capable of conveniently disengaging loads by a remote operator located on the ground, which is not susceptible to inadvertent load release, and which does not require the use of an additional crane or manlift during operation for compliance with applicable worker safety legislation.

These and other objects are addressed by the present invention, a safety lifting device, for detachable interconnection between a lifting means and a lifting lug rigidly attached to a load to be lifted.

According to one aspect of the invention, the safety is lifting device comprises a body member extending downwardly between an upper end and a lower end thereof so as to define a longitudinal axis therebetween. The body member has a throughpassage adjacent its lower end, said throughpassage extending between first and second lateral sides of the body member so as to define an axis of said throughpassage substantially transverse to said longitudinal axis. A shackle means for rigidly connecting the body member to the lifting means is also provided in the present invention, as well as a lift pin member having a head portion of larger cross-sectional dimension than said throughpassage and a shaft portion extending from said head portion along a major axis of the lift pin member to a free end. The lift pin member has a transverse bore axially extending through the shaft portion adjacent the free end in a direction substantially normal to the major axis of the lift pin member. The shaft portion is slidably insertable into the throughpassage in a first axial direction, to a fully inserted position, at which fully inserted position a terminal section of the shaft portion containing the free end and the transverse bore projects from the first lateral side of the body member, with the transverse bore being substantially vertically oriented. The head portion projects from the second lateral side of the body member, and an intermediate section of the shaft portion extends between the terminal section and the head portion and is positioned with respect to the body member so as to provide for contacting, lifting engagement with the lifting lug. A stop pin member is also provided in the present invention, having a head portion of larger cross-sectional dimension than the transverse bore, and a shaft portion extending from the head portion along a major axis of the stop pin member. The shaft portion is slidably insertable, with the assistance of gravity, into the transverse bore in a first pin direction to a locked position, when the shaft portion of the lift pin member is at the fully inserted position. At the locked position, the head portion of the stop pin member provides interfering contact with the first lateral side of the body member, so as to prevent pulling, sliding withdrawal of the shaft portion of the lift pin member from within the throughpassage in a second axial direction opposed to said first axial direction. Additionally, there is provided a lift pin pull line having a proximal end connected to the head portion of the lift pin member, and a distal end operatively positioned below the body member, for pulling, sliding withdrawal of the shaft portion thereof from within the throughpassage in the second axial direction. There is also provided a stop pin pull line having a proximal end connected to the head portion of the stop pin member, and a distal end operatively positioned below the body member, for pulling, sliding withdrawal of the shaft portion thereof from within the transverse bore in a second pin direction opposed to the first pin direction. A first guide means is also provided for directing tensile force operatively applied upon the stop pin pull line at its distal end to the head portion of the stop pin member in substantially the second pin direction, the first guide means being operatively mounted on the body member.

According to another aspect of the present invention, the throughpassage comprises two laterally-opposed coaxial bores flanking a downwardly-projecting channel defined by the body member adjacent the lower end thereof, the downwardly-projecting channel being transversely intersected by the throughpassage.

According to another aspect of the present invention, the downwardly-projecting channel is adapted to operatively receive the lifting lug, such that, upon receipt of the lifting lug by the channel, and upon the aforementioned sliding insertion of the shaft portion of the lift pin member into the throughpassage in the first axial direction to the fully inserted position, the intermediate portion of the shaft portion is substantially disposed within the channel so as to provide contacting, lifting engagement with the lifting lug.

According to another aspect of the present invention, the safety lifting device further comprises arresting means for arresting rotation of the lift pin member about its major axis relative to the body member when the shaft portion of the lift pin member is at the fully inserted position.

According to yet another aspect of the present invention, the arresting means for arresting rotation of the lift pin member about its major axis relative to the body member comprises a key plate rigidly attached to the head portion of the lift pin member, and guide bars mounted on the second lateral side of the body member on opposite sides of the throughpassage, with the guide bars and key plate being mounted such that, when the shaft portion of the lift pin member is at the fully inserted position within the throughpassage, rotation of the lift pin member about its major axis and relative to the body member is arrested by impingement of the key plate upon the guide bars.

Other advantages, features and characteristics of the is present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
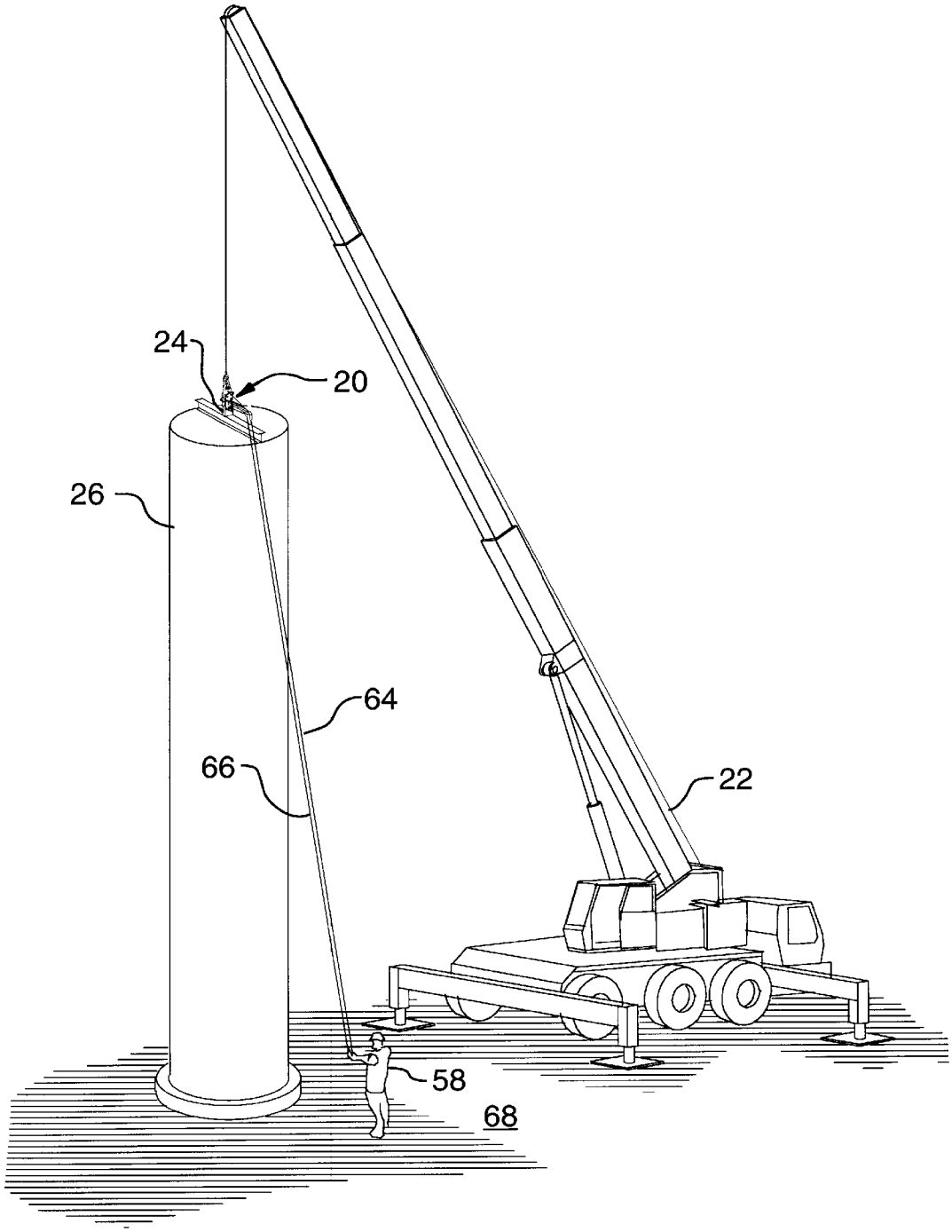
FIG. 1 is a perspective view of a crane, with a safety lifting device according to a preferred embodiment of the present invention rigidly connected to the crane and to a lifting lug, which lifting lug, in turn, is rigidly attached to a load to be lifted.

In FIG. 1, there is shown a typical application of the safety lifting device of the present invention. FIG. 1 shows a load 26 having a lifting lug 24 rigidly attached thereto; a lifting means 22, being, in this application, a crane; a safety lifting device according to a preferred embodiment of the present invention, and designated by the general reference numeral 20; and an operator 58. The safety lifting device 20 is shown detachably interconnecting the lifting means 22 and the lifting lug 24, and the operator 58 is shown located on the ground 68, safely laterally distant from the load 26, holding a stop pin tag line 64 and a lift pin tag line 66 operatively attached to the safety lifting device 20, for detachment of said interconnection, as described more fully below.

Figure 2:
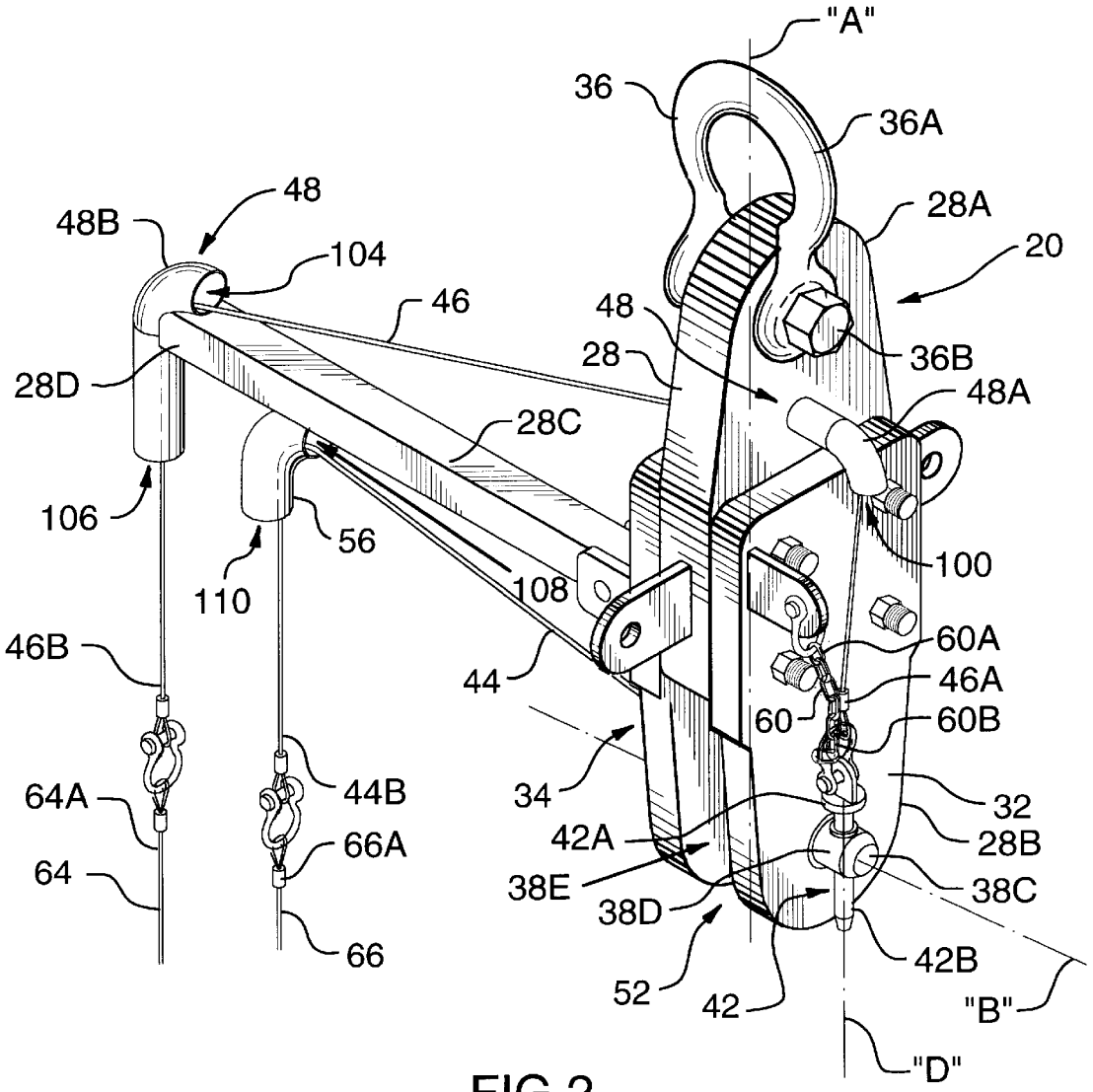
FIG. 2 is a perspective view on an enlarged scale of the safety lifting device of FIG. 1, showing the first lateral side of said safety lifting device.
Figure 3:
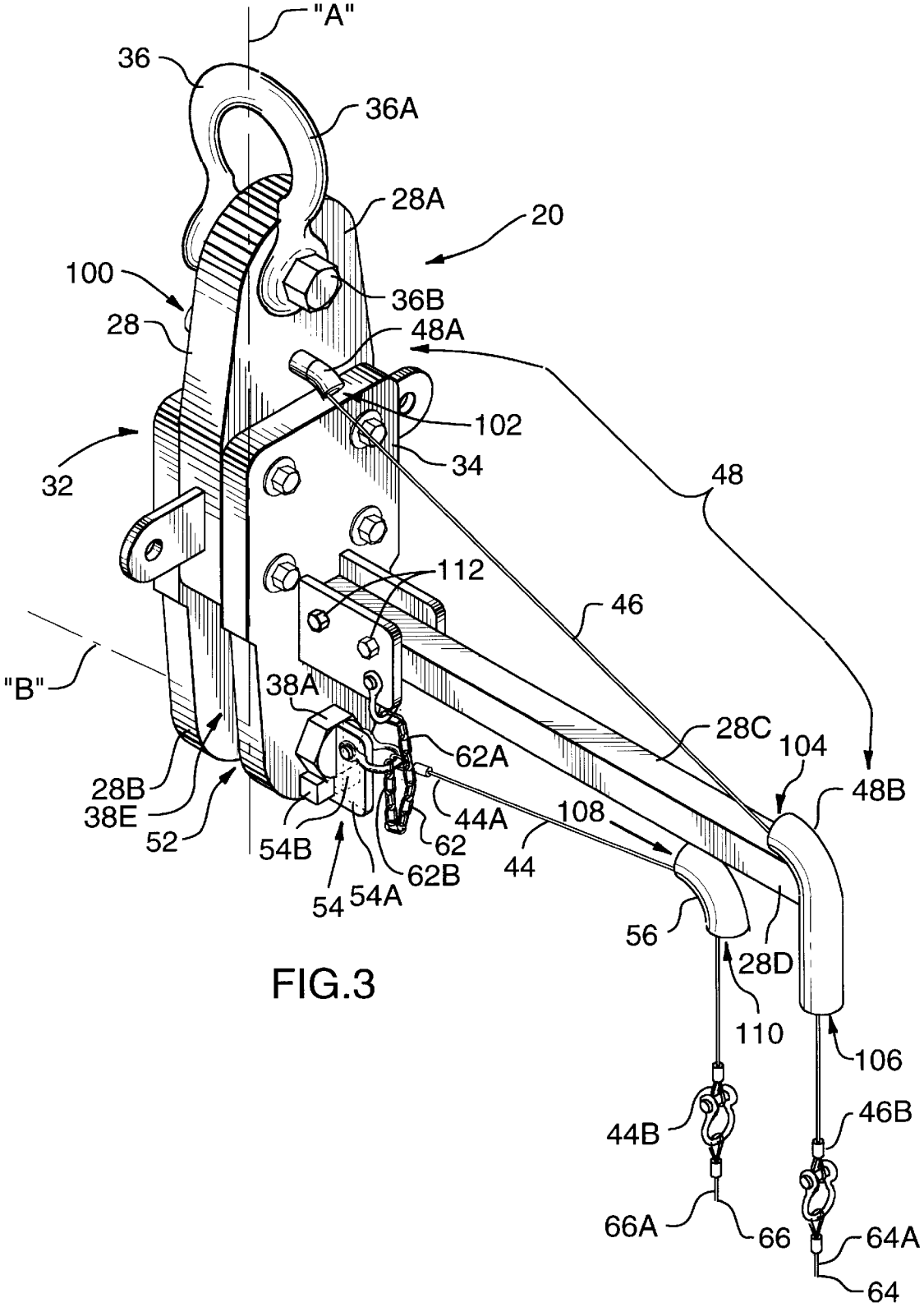
FIG. 3 is a perspective view of the safety lifting device of FIG. 2, showing the second lateral side of said safety lifting device.
Figure 4:
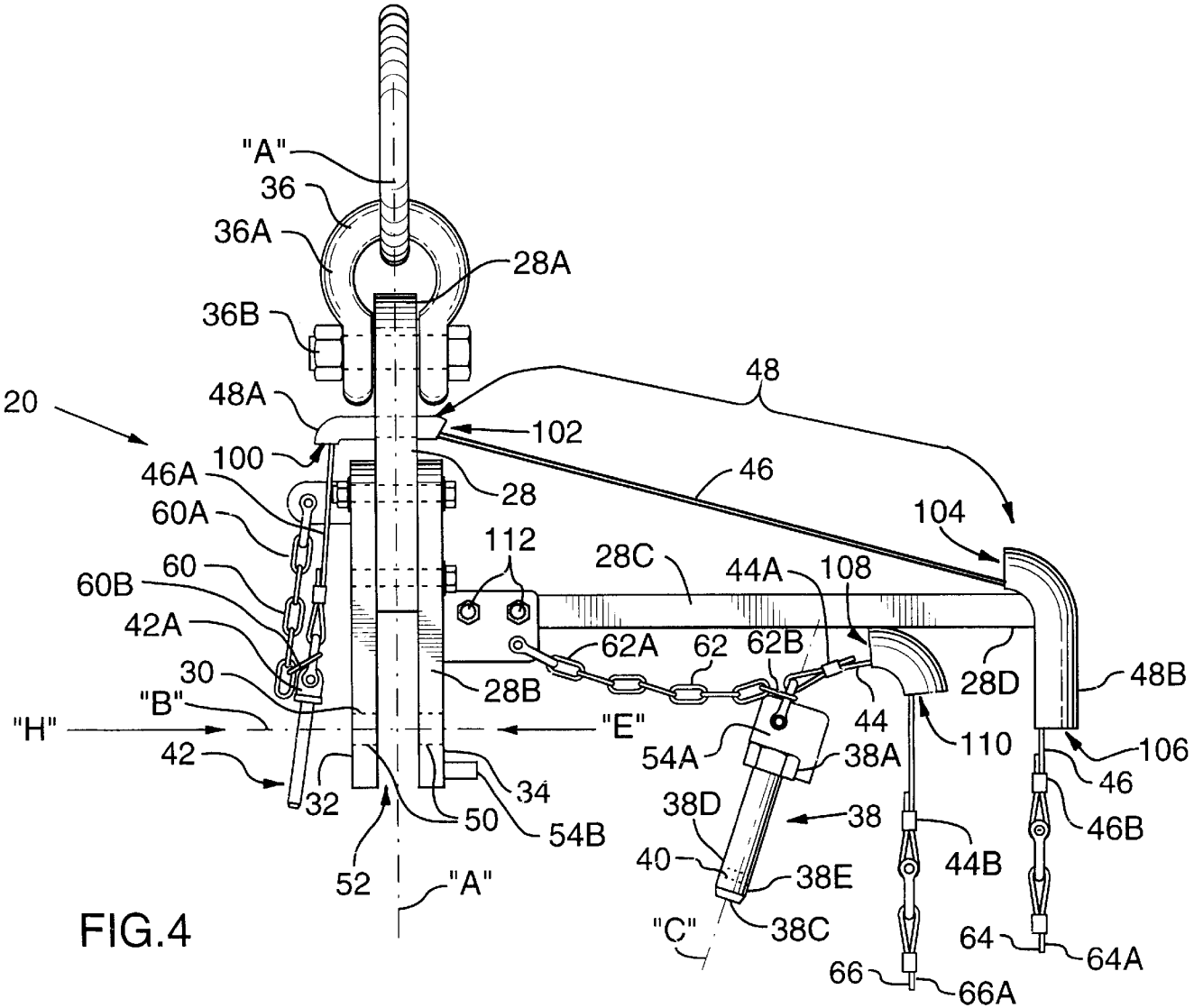
FIG. 4 is a front elevational view of the safety lifting device of FIGS. 2 and 3, with the lift pin member withdrawn from the throughpassage and the stop pin member withdrawn from the transverse bore.
Figure 8:
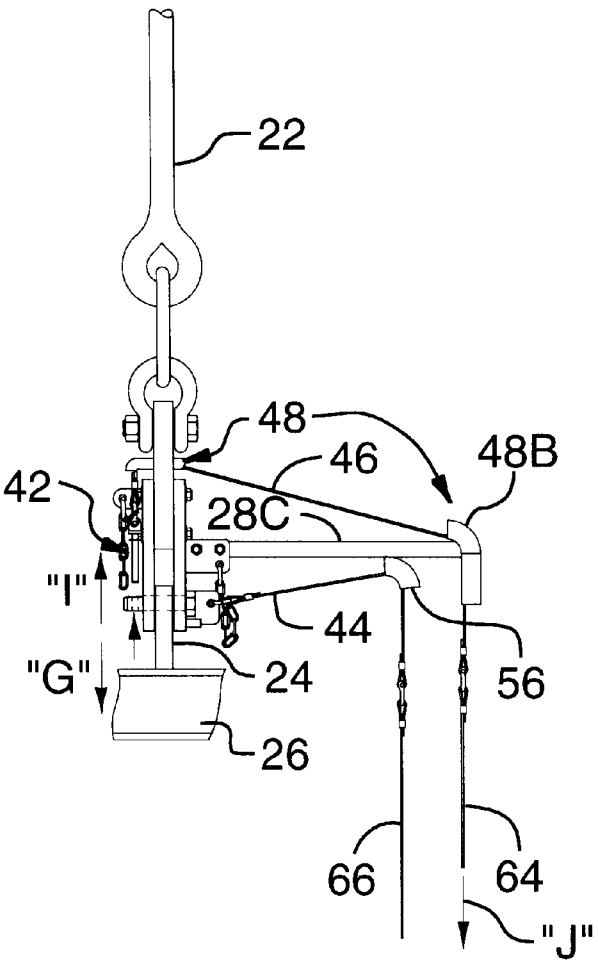
FIG. 8 is a front elevational view similar to FIG. 7, but showing the stop pin member withdrawn from the transverse bore.
Figure 7:
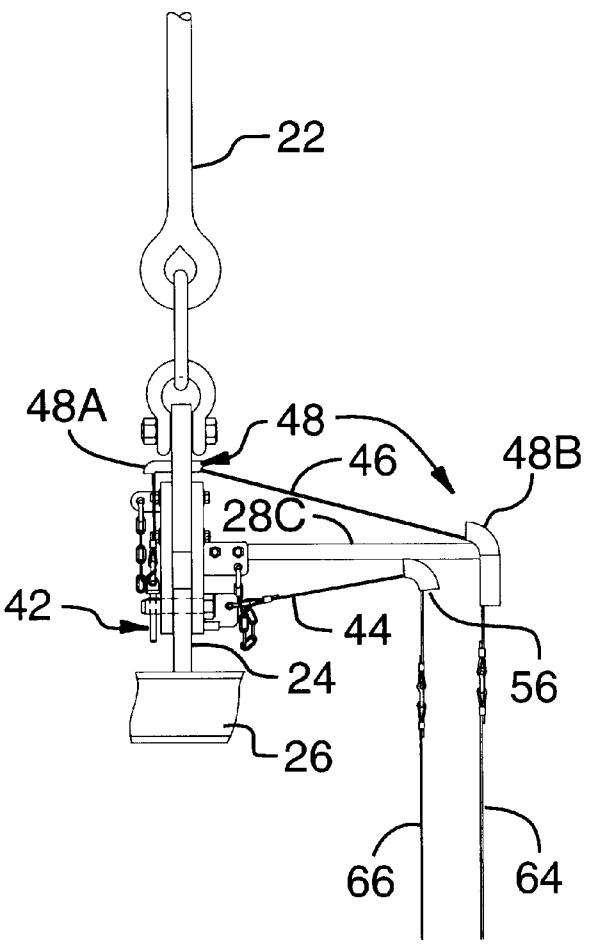
FIG. 7 is a front elevational view of the safety lifting device, lifting lug and load of FIG. 1.
Figure 10:
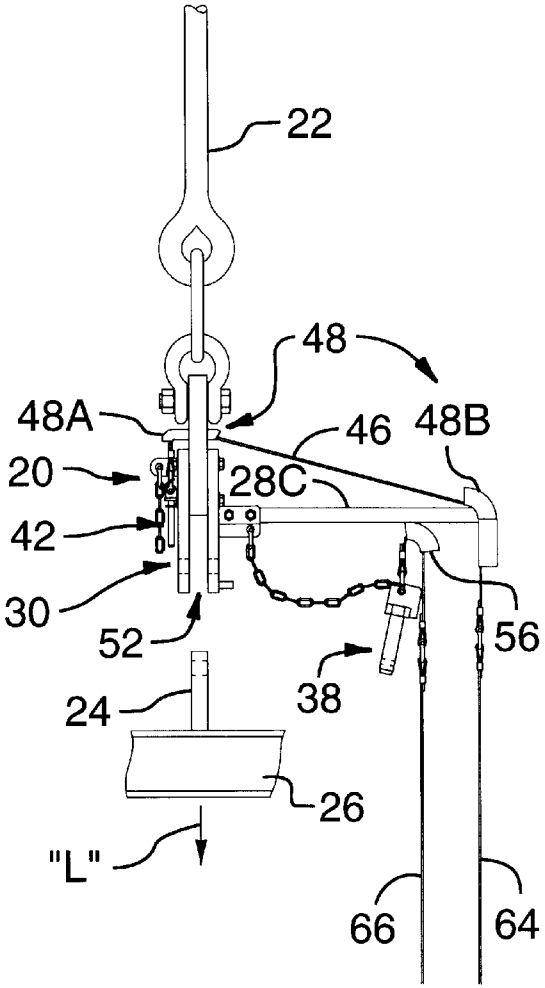
FIG. 10 is a front elevational view similar to FIG. 9, but showing the load disconnected from the safety lifting device.
Figure 9:
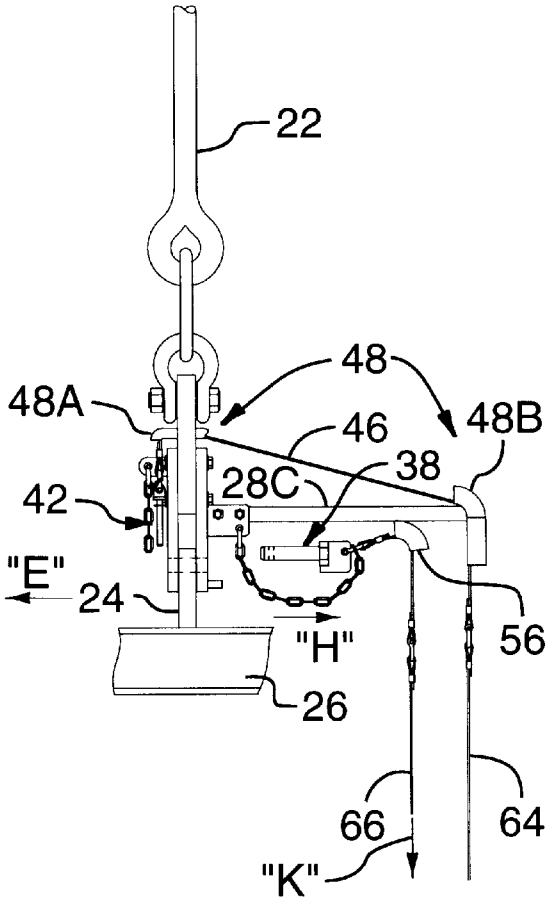
FIG. 9 is a front elevational view similar to FIG. 8, but showing the lift pin member withdrawn from the throughpassage.

The safety lifting device 20 of the present invention will now be more fully described with particular reference to FIGS. 2 through 10. In FIGS. 2 and 31 there will be seen a safety lifting device 20 of the present invention comprising a body member 28 extending downwardly between an upper end 28A and a lower end 28B thereof, so as to define a longitudinal axis "A" therebetween. As best seen in FIGS. 4,9 and 10, the body member 28 has a throughpassage 30 adjacent its lower end 28B, which throughpassage 30 extends between first 32 and second 34 lateral sides of the body member 28 so as to define an axis "B" of said throughpassage 30 substantially transverse to said longitudinal axis "A".

There is also provided a shackle means 36 for rigidly connecting the body member 28 to the lifting means 22. In the preferred embodiment illustrated, the shackle means 36 comprises a shackle 36A, rigidly connected to the upper end 28A of the body member 28 by a conventional structural bolt 36B. However, other known means (not shown) of connecting the body member to the lifting means can be utilized, with similar utility.

Figure 5:
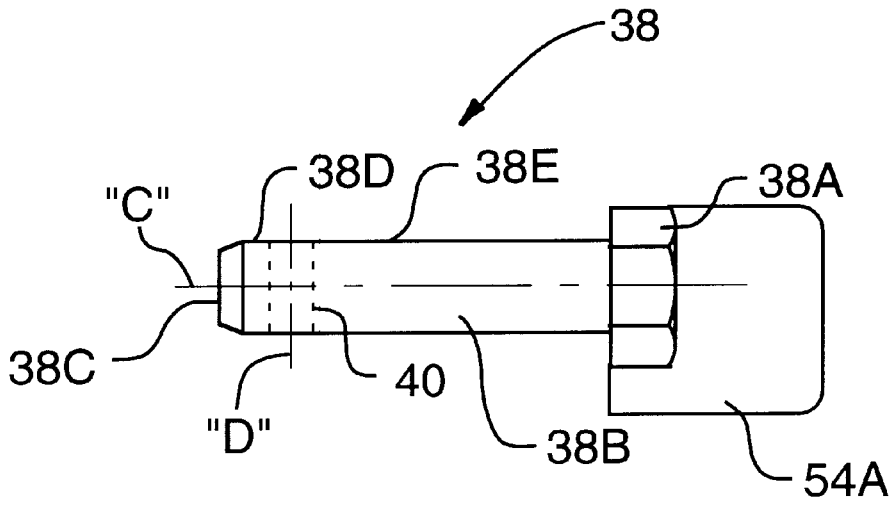
FIG. 5 is an elevational view of the lift pin member and key plate of the safety lifting device of FIG. 4.

A lift pin member 38 is also provided. As best seen in FIGS. 4 and 5, the lift pin member 38 has a head portion 38A of larger cross-sectional dimension than the throughpassage 30, and a shaft portion 38B extending from the head portion 38A along a major axis "C" of the lift pin member 38 to a free end 38C. Additionally, the lift pin member 38 has a transverse bore 40 extending through the shaft portion 38B thereof, adjacent the free end 38C, in an axial direction, indicated by arrow "D" of FIGS. 4 and 9, substantially normal to the major axis "C" of the lift pin member 28. The shaft portion 382 is slidably insertable into the throughpassage 30, in a first axial direction, indicated by arrow "E" of FIG. 9, to a fully inserted position shown in FIGS. 1, 2, 3, 7 and 8. At the fully inserted position, a terminal section 38D of the shaft portion 38B, containing the free end 38C and the transverse bore 40, projects from the first lateral side 32 of the body member 28, with the transverse bore 40 being substantially vertically oriented (most clearly seen in FIG. 2). At the fully inserted position, the head portion 38A projects from the second lateral side 34 of the body member 28 (most clearly seen in FIG. 3), and an intermediate section 38E of the shaft portion 38B extends between the terminal section 38D and the head portion 38A and is positioned with respect to the body member 28 so as to provide for contacting, lifting engagement with said lifting lug 24.

Figure 6:
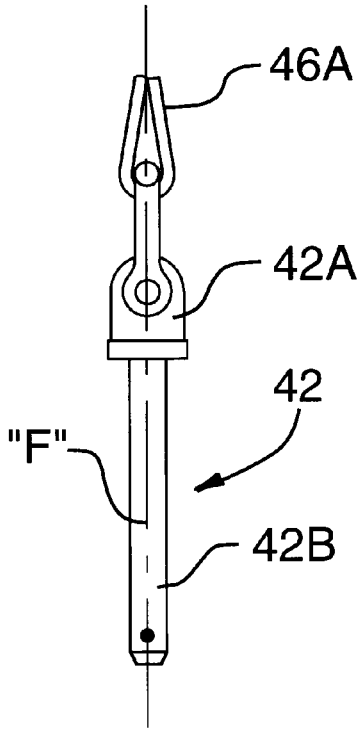
FIG. 6 is an elevational view of the stop pin member of the safety lifting device of FIG. 4.

Most clearly illustrated in FIGS. 2 and 6, the safety lifting device 20 also comprises a stop pin member 42, having a head portion 42A of larger cross-sectional dimension than said transverse bore 40 and a shaft portion 42B extending from said head portion 42A along a major axis "F" of the stop pin member 42. When the shaft portion 38B of the lift pin member 38 is at the fully inserted position, as previously described, the shaft portion 42B of the stop pin member 42 is slidably insertable with the assistance of gravity into the transverse bore 40, in a first pin direction, which is generally downwardly directed, and is indicated by arrow "G" in FIG. 8, to a locked position. The stop pin member 42 is shown in the locked position in FIGS. 2 and 7. At the locked position of the stop pin member 42, the head portion 42A of the stop pin member 42 provides interfering contact with the first lateral side 32 of the body member 28, so as to prevent pulling, sliding withdrawal of the shaft portion 38B of the lift pin member 28 from within the throughpassage 30 in a second axial direction, indicated by arrow "H" of FIG. 9, opposed to said first axial direction, indicated by arrow "E" of FIG. 9.

As best seen in FIGS. 2 and 3, a lift pin pull line 44 is also provided, having a proximal end 44A connected to the head portion 38A of the lift pin member 38, and having a distal end 44B operatively positioned below the body member 28, for pulling, sliding withdrawal of the shaft portion 38B of the lift pin member 38 from within the throughpassage 30 in the second axial direction indicated by arrow "H" of FIG. 9.

Similarly, as best seen in FIGS. 2 and 3, a stop pin pull line 46 is provided, having a proximal end 46A connected to the head portion 42A of the stop pin member 42 and a distal end 46B operatively positioned below the body member 28, for pulling, sliding withdrawal of the shaft portion 42B of the stop pin member 42 from within the transverse bore 40 in a second pin direction (indicated by arrow "I" of FIG. 8) opposed to said first pin direction indicated by arrow "G".

The use of the independent stop pin pull line 46 and lift pin pull line 44 in the present invention works to greatly decrease the risk of accidental load release, since, in order to effect the release of the lug 24 and the load 26 thereto attached, tensile force must be applied sequentially, first upon the stop pin pull line 46, and then upon the lift pin pull line 44, with the statistical likelihood of such a sequential application of tensile force occurring unintentionally, i.e. as a result of the pull lines 44, 46 becoming snagged, etc. being much less than in the case of the prior art devices utilizing one common pull line.

Additionally, there is also provided in the present invention a first guide 48 means for directing tensile force operatively applied upon the stop pin pull line 46 at its distal end 46B to the head portion 42A of the stop pin member 42 in substantially the second pin direction (indicated by arrow "I"), such that, when the stop pin member 42 is at the locked position, application of tensile force upon the stop pin pull line 46 withdraws the stop pin member 42 from the transverse bore 40. The first guide means 48 is operatively mounted on the body member 28, and will described more fully below.

As best seen in FIG. 4, the throughpassage 30 preferably comprises two laterally-opposed coaxial bores 50, 50 flanking a downwardly-projecting channel 52 defined by the body member 28 adjacent the lower end 28B thereof, said downwardly-projecting channel 52 being transversely intersected by the throughpassage 30. The channel 52 is adapted to operatively receive said lifting lug 24, such that, upon receipt of said lifting lug 24 by the channel 52, and upon said sliding insertion of the shaft portion 38B of the lift pin member 38 into the throughpassage 30 in said first axial direction, depicted by arrow "E", to the fully inserted position, the intermediate portion 38E of the shaft portion 38B is substantially disposed within the channel 52 so as to provide contacting, lifting engagement with said lifting lug 24. The inclusion of the open-ended channel 52 is preferable, in that it allows the safety lifting device 20 of the present invention to be utilized with lifting lugs of many different dimensions.

In the preferred embodiment illustrated, there is also provided arresting means for arresting rotation of the lift pin member 38 about its major axis "C" relative to the body member 28 when the shaft portion 38B of the lift pin member 38 is at the fully inserted position. As best seen in FIG. 3, the arresting means, designated by the general reference numeral 54, preferably comprises a key plate 54A rigidly attached to the head portion 38A of the lift pin member 38, and guide bars 54B mounted on the second lateral side 34 of the body member 28 on opposite sides of the throughpassage 30. The guide bars 54B and key plate 54A are mounted such that, when the shaft portion 38B of the lift pin member 38 is at the fully inserted position in the throughpassage 30, rotation of the lift pin member 38 about its major axis "C" and relative to the body member 28 is arrested by impingement of the key plate 54A upon the guide bars 54B. Such a feature of the invention is not strictly necessary, but is preferable, as rotation of the lift pin member 38 does not normally occur during operation. However, in some circumstances, such as when loads shift or collide with other objects during operation, the lift pin member 38 might rotate within the throughpassage 30, absent such arresting means 54, with the result that it will become more difficult, or impossible, for the operator 58 to withdraw the stop pin member 42 from the transverse bore 40. That is, in such circumstances, it will be appreciated that tensile force applied upon the stop pin pull line 46 will be directed by the first guide means 48 such that it is applied upon the head 42A of the stop pin member 42 in angular relation to the second pin direction, as indicated by arrow "I", with the result that additional tensile force will be required to be applied by the operator 58 upon the stop pin pull line 46 to effect withdrawal of the stop pin member 42 from the transverse bore 40 (not shown).

Preferably, the first guide means 48 comprises a first stop pin pull line conduit 48A positioned adjacent the upper end 28A of the body member 28 and extending from a first opening 100 adjacent the first lateral side 32 through said body member 28 to a second opening 102 adjacent the second lateral side 34, through which conduit 48A said stop pin pull line 46 passes. The first opening 100 is oriented generally downwardly toward the axis "D" of said transverse bore 40, when the lift pin member 38 is at the fully inserted position. The second opening 102 is oriented generally downwardly and laterally away from the second lateral side 34 of the body member 28. It is evident that tensile force operatively applied by the operator 58 upon the stop pin pull line 46 at its distal end 46B is directed by the first stop pin pull line conduit 48A to the head portion 42A of the stop pin member 42 in substantially the second pin direction, as indicated by arrow "I"; accordingly, the operator 58 on the ground 68 laterally and downwardly distant from the safety lifting device 20 may selectively effect said pulling sliding withdrawal of the shaft portion 42B of the stop pin member 42 from within the transverse bore 40 by the operative application of tensile force upon the stop pin pull line 46.

Preferably, the body member 28 further comprises an outrigger arm 28C, shown best in FIGS. 2, 3 and 4, which laterally extends from the second lateral side 34 of the body member 28 to a distal end 28D, and the first guide means 48 further comprises a second stop pin pull line conduit 48B, in the form of a 90° elbow, through which the stop pin pull line 46 also passes, said second stop pin pull line conduit 48B being mounted adjacent the distal end 28D of the outrigger arm 28C, and having a first opening 104 and a second opening 106 thereof. The first opening 104 is substantially oriented toward the second opening 102 of the first stop pin pull line conduit 48A. The second stop pin pull line conduit 48B extends from the first opening 104 substantially downwardly to the second opening 106, which second opening 106 is oriented substantially downwardly. The inclusion of the second stop pin pull line conduit 48B is preferable, as it allows an operator 58 on the ground 68, located generally downwardly distant from the distal end 28D of the outrigger arm 28C, to selectively effect pulling sliding withdrawal of the shaft portion 42B of the stop pin member 42 from within the transverse bore 40 by the application of tensile force upon the stop pin pull line 46. It will be appreciated that, absent the inclusion of the outrigger arm 28C and second stop pin pull line conduit 48B, the operator 58, in order to apply operative tensile force upon the stop pin pull line 46 might be required to be positioned substantially laterally distant from the safety lifting device 20 in order to avoid interference between the load 26 and the stop pin pull line 46, which placement might be difficult in certain situations, might prevent the operator 58 from assisting in the positioning of the load 26, and might also dangerously impair the operator's 58 view of the safety lifting device 20.

Second guide means 56 are also preferably provided for directing tensile force operatively applied upon the lift pin pull line 44 at its distal end 44B to the head portion 38A of the lift pin member 38 in substantially the second axial direction depicted by the arrow "H". The second guide means 56 preferably comprises a lift pin pull line conduit 56, in the form of a 90° elbow, through which the lift pin pull line 44 passes, said lift pin pull line conduit 56 being mounted adjacent the distal end 28D of said outrigger arm 28C inboard from the second stop pin pull line conduit 48B and having a first opening 108 and a second opening 110. The first opening 108 is substantially oriented toward the throughpassage 30. The lift pin pull line conduit 56 extends substantially downwardly from said first opening 108 to the second opening 110, which is oriented substantially downwardly. The inclusion of the second guide means 56 is not strictly necessary, as an operator 58 sufficiently lateral distant from the safety lifting device 20 so as to avoid interference with the load 26 being lifted would normally be able to apply operative tensile force upon the lift pin pull line 44 to detach the safety lifting device 20 from the lifting lug 24. However, inclusion of second guide means 56 to properly direct tensile force facilitates withdrawal of the lift pin member 38 with relatively less effort than would be required otherwise; additionally, inclusion of second guide means 56 adjacent the distal end 28D of the outrigger arm 28C enables an operator 58 to effect withdrawal of the lift pin member 38 without interference with the load 26, at lesser lateral distance than would otherwise be the case, which can be of particular benefit when the operator 58 of the safety lifting device 20 is also assisting in the positioning of the load 26.

In order to prevent the stop pin member 42 from falling upon withdrawal of the stop pin member 42 from the transverse bore 40, which would imperil the operator 58 and others on the ground 68 below, the safety lifting device 20 will preferably also include a first safety chain 60 for the stop pin member 42, said first safety chain 60 being rigidly attached at its opposite ends 60A and 60B to the body member 28 and the head portion 42A of the stop pin member 42, respectively.

Similarly, a second safety chain 62 for the lift pin member 38 will preferably also be provided, said second safety chain 62 being rigidly attached at its opposite ends 62A and 62B to the body member 28 and the head portion 38A of the lift pin member 38, respectively.

In the preferred embodiment illustrated, the stop pin pull line 46 and lift pin pull line 44, which are subject to heavy wear in the first and second guide means 48 and 56, respectively, are preferably constructed of metal wire rope, for durability. There is also provided a stop pin tag line 64 and lift pin tag line 66, adapted for detachable interconnection at respective ends 64A and 66A to the distal ends 46B and 44B of the stop pin pull line 46 and lift pin pull line 44, which stop pin tag line 64 and lift pin tag line 66 are preferably constructed of non-metallic rope. The use of non-metallic rope is preferable, for weight purposes, to assist the operator 58 in handling the safety lifting device 20, and also from the standpoint of electrical conductivity, to minimize the risk to the operator 58 of electrocution, since lifting operations are occasionally carried out in the presence of overhead electrical wires. It should also be appreciated that, in addition to the aforementioned benefits relating to the non-metallic tag lines, the use of detachable tag lines is also preferable, as such configuration is readily adaptable to the use of tag lines of various lengths, as may be required for particular lifting operations, and also for ready replacement of worn or damaged tag lines, for reasons of safety.

The safety lifting device 20 is preferably further constructed with the lift pin pull line 44 and lift pin tag line 66 constructed of materials of a first colour, preferably red, and the stop pin pull line 46 and stop pin tag line 64 constructed of materials of a second contrasting colour, preferably yellow. Such a colour scheme implies a sequence of operations, i.e. that the yellow line 46 is to be pulled first, with caution, followed by the red line 44, which can cause a dangerous action, namely, release of the load 26. In this way, the possibility of inadvertent release of the load is further minimized.

The safety lifting device 20 is also preferably constructed such that the outrigger arm 28C is adapted for easily-removable rigid connection to the second lateral side 34 of the body member 28. This feature is preferred, as it allows outrigger arms of various lengths to be readily substituted, as may be required for particular lifting operations. The outrigger arm 28C is shown to be connected to the second lateral side 34 of the body member 28 by use of conventional nut and bolts assemblies 112; any other conventional means of connection, such as dowel pins (not shown) may similarly be utilized.

FIGS. 7 through 10 illustrate the sequential operation of the preferred embodiment of the safety lifting device 20. The safety lifting device 20 is rigidly connected to the lifting means 22, with the lifting lug 24 of the load 26 to be lifted being operatively received by the channel 52 of the safety lifting device 20, and the lift pin member 38 at the fully inserted position in the throughpassage 30, so as to provide contacting, lifting engagement with the lifting lug 24. As well, the stop pin member 42 is fully inserted in the transverse bore 40, at its locked position, so as to prevent withdrawal of the lift pin member 38 from within the throughpassage 30.

To release the load 26 from the lifting means 22, tensile force is operatively applied firstly upon the stop pin tag line 64, in the direction of arrow "J" in FIG. 8. The stop pin tag line 64 is attached to the stop pin pull line 46, which passes through the second stop pin pull line conduit 48B and through the first stop pin pull line conduit 48A to connection with the head portion 42A of the stop pin member 42. Such tensile force is directed upon the head portion 42A of the stop pin member 42 in substantially the second pin direction, indicated by arrow "I", thereby effecting the withdrawal of the stop pin member 42 from the transverse bore 40, thereby to enable the subsequent withdrawal of the lift pin member 38 from the throughpassage 30.

Withdrawal of the lift pin member 38 from the throughpassage 30 is effected by subsequent application of tensile force upon the lift pin tag line 66, in the direction indicated by arrow "K" in FIG. 9. The lift pin tag line 66 is attached to the lift pin pull line 44, which extends through the lift pin pull line conduit 56 to the head portion 38A of the lift pin member 38. Such tensile force is directed upon the head portion 38A of the lift pin member 38, in substantially the second axial direction depicted by arrow "H", thereby withdrawing the lift pin member 38 from the throughpassage 30, disconnecting the safety lifting device 20 from the lifting lug 24.

The lifting lug 24 is freely separated from the safety lifting device 20 in the direction indicated by arrow "L" in FIG. 10, thereby disconnecting the load 26 from the lifting means 22.

With general reference to the aforementioned FIGS. 7 through 10, it will be appreciated that, while the lifting lug 24 is illustrated in the Figures to be rigidly incorporated into the structure of the load 26, the lifting lug 24 could be attached to the load 26 by any other conventional attachment means, such as nut and bolt assemblies, or the like.

Additionally, while but a single specific embodiment of the present invention is herein shown and described, it will be understood that various changes in size and shape of parts may be made without departing from the spirit and scope of invention.

I claim:

1. A safety lifting device for detachable interconnection between a lifting means and a lifting lug rigidly attached to a load to be lifted, said safety lifting device comprising:

a body member extending downwardly between an upper end and a lower end thereof so as to define a longitudinal axis therebetween, said body member having a throughpassage adjacent its lower end, said throughpassage extending between first and second lateral sides of the body member so as to define an axis of said throughpassage substantially transverse to said longitudinal axis;

a shackle means for rigidly connecting the body member to said lifting means;

a lift pin member having a head portion of larger cross-sectional dimension than said throughpassage and a shaft portion extending from said head portion along a major axis of the lift pin member to a free end, said lift pin member having a transverse bore axially extending through said shaft portion adjacent the free end in a direction substantially normal to the major axis of the lift pin member, said shaft portion being slidably insertable into said throughpassage in a first axial direction to a fully inserted position, at which fully inserted position a terminal section of the shaft portion containing the free end and the transverse bore projects from the first lateral side of the body member with the transverse bore being substantially vertically oriented, the head portion projects from the second lateral side of the body member, and an intermediate section of the shaft portion extending between the terminal section and the head portion is positioned with respect to the body member so as to provide for contacting, lifting engagement with said lifting lug;

a stop pin member having a head portion of larger cross-sectional dimension than said transverse bore and a shaft portion extending from said head portion along a major axis of the stop pin member, said shaft portion being slidably insertable with the assistance of gravity into the transverse bore in a first pin direction to a locked position when the shaft portion of the lift pin member is at the fully inserted portion, at which locked position the head portion of the stop pin member provides interfering contact with the first lateral side of the body member, so as to prevent pulling, sliding withdrawal of the shaft portion of the lift pin member from the throughpassage in a second axial direction opposed to said first axial direction;

a lift pin pull line having a proximal end connected to the head portion of the lift pin member and a distal end operatively positioned below the body member, for pulling, sliding withdrawal of the shaft portion of the lift pin member from within the throughpassage in said second axial direction;

a stop pin pull line having a proximal end connected to the head portion of the stop pin member and a distal end operatively positioned below the body member, for pulling, sliding withdrawal of the shaft portion of the stop pin member from within the transverse bore in a second pin direction opposed to said first pin direction; and a first guide means for directing tensile force operatively applied upon the stop pin pull line at its distal end to the head portion of the stop pin member in substantially the second pin direction, said first guide means being operatively mounted on the body member.

2. A safety lifting device according to claim 1, wherein the throughpassage comprises two laterally-opposed coaxial bores flanking a downwardly-projecting channel defined by the body member adjacent the lower end thereof, said downwardly-projecting channel being transversely intersected by said throughpassage.

3. A safety lifting device according to claim 2, wherein the channel is adapted to operatively receive said lifting lug, such that, upon receipt of said lifting lug by the channel, and upon said sliding insertion of the shaft portion of the lift pin member into the throughpassage in said first axial direction to the fully inserted position, the intermediate portion of the shaft portion is substantially disposed within the channel so as to provide contacting, lifting engagement with said lifting lug.

4. A safety lifting device according to claim 3, further comprising arresting means for arresting rotation of the lift pin member about its major axis relative to the body member when the shaft portion of the lift pin member is at the fully inserted position.

5. A safety lifting device according to claim 4, wherein the arresting means comprises a key plate rigidly attached to the head portion of the lift pin member, and guide bars mounted on the second lateral side of the body member on opposite sides of the throughpassage, said guide bars and key plate being mounted such that, when the shaft portion of the lift pin member is at the fully inserted position within the throughpassage, rotation of the lift pin member about its major axis and relative to the body member is arrested by impingement of the key plate upon the guide bars.

6. A safety lifting device according to claim 5, wherein the first guide means comprises a first stop pin pull line conduit positioned adjacent the upper end of the body member and extending from a first opening adjacent the first lateral side through said body member to a second opening adjacent the second lateral side, through which conduit said stop pin pull line passes, said first opening being oriented generally downwardly toward the axis of said transverse bore when the lift pin member is at the fully inserted position, said second opening being oriented generally downwardly and laterally away from the second lateral side of the body member, whereby an operator on the ground operatively laterally and downwardly distant from the safety lifting device may selectively effect said pulling sliding withdrawal of the shaft portion of the stop pin member from within the transverse bore by the operative application of tensile force upon the stop pin pull line.

7. A safety lifting device according to claim 6, wherein the body member further comprises an outrigger arm, laterally extending from the second lateral side of the body member to a distal end, and the first guide means further comprises a second stop pin pull line conduit through which the stop pin pull line passes, said second stop pin pull line conduit being mounted adjacent the distal end of said outrigger arm and having a first opening and a second opening, the first opening being oriented generally toward the second opening of the first stop pin pull line conduit, said second stop pin pull line conduit extending substantially downwardly from said first opening to said second opening, said second opening being oriented substantially downwardly, whereby an operator on the ground substantially downwardly distant from the distal end of the outrigger arm may selectively effect said pulling sliding withdrawal of the shaft portion of the stop pin member from within the transverse bore by the operative application of tensile force upon the stop pin pull line.

8. A safety lifting device according to claim 7, wherein the second stop pin pull line conduit is in the form of a 90° elbow.

9. A safety lifting device according to claim 8, further comprising a second guide means for directing tensile force operatively applied upon the lift pin pull line at its distal end to the head portion of the lift pin member in substantially the second axial direction.

10. A safety lifting device according to claim 9, wherein the second guide means comprises a lift pin pull line conduit through which the lift pin pull line passes, said lift pin pull line conduit being mounted adjacent the distal end of said outrigger arm inboard from the second stop pin pull line conduit and having a first opening and a second opening, the first opening being oriented substantially toward the throughpassage, said lift pin pull line conduit extending substantially downwardly from said first opening to said second opening, said second opening being oriented substantially downwardly, whereby an operator substantially downwardly distant from the distal end of the outrigger arm may selectively effect said pulling sliding withdrawal of the shaft portion of the lift pin member from within the throughpassage by the operative application of tensile force upon the lift pin pull line at its distal end, so as to detach the safety lifting device from the lifting lug.

11. A safety lifting device according to claim 10, wherein the lift pin pull line conduit is in the form of a 90° elbow.

12. A safety lifting device according to claim 11, further comprising a first safety chain for the stop pin member, said first safety chain being rigidly attached at its opposite ends to the body member and the head portion of the stop pin member.

13. A safety lifting device according to claim 12, further comprising a second safety chain for the lift pin member, said second safety chain being rigidly attached at its opposite ends to the body member and the head portion of the lift pin member.

14. A safety lifting device according to claim 13, further comprising a stop pin tag line having a proximal end adapted for detachable interconnection to the distal end of the stop pin pull line, and a distal end operatively positioned below the body member.

15. A safety lifting device according to claim 14, further comprising a lift pin tag line having a proximal end adapted for detachable interconnection to the distal end of the lift pin pull line, and a distal end operatively positioned below the body member.

16. A safety lifting device according to claim 15, wherein the stop pin pull line and lift pin pull line are constructed from metal wire rope.

17. A safety lifting device according to claim 16, wherein the stop pin tag line and lift pin tag line are constructed from non-metallic rope.

18. A safety lifting device according to claim 17, wherein the stop pin tag line and stop pin pull line are constructed from materials of a first colour, and the lift pin tag line and lift pin pull line are constructed of materials of a second contrasting colour.

19. A safety lifting device according to claim 18, wherein the first colour is yellow, and the second colour is red.

20. A safety lifting device according to claim 19, wherein the outrigger arm is adapted for easily-removable rigid connection to the second lateral side of the body member.

* * * * *